US005361699A

United States Patent [19]

Compera

[11] Patent Number: 5,361,699

[45] Date of Patent: Nov. 8, 1994

[54] HOLDING DEVICE FOR A PLATE WHICH IS TO BE DISPLACED

[75] Inventor: Christian Compera, Dossenheim, Germany

[73] Assignee: Heidelberger Druckmaschinen AG, Heidelberg, Germany

[21] Appl. No.: 54,963

[22] Filed: Apr. 29, 1993

[30] Foreign Application Priority Data

Apr. 29, 1992 [DE] Germany ..... 4214047

[51] Int. Cl.[5] ..... B41F 1/32

[52] U.S. Cl. ..... 101/477; 101/415.1

[58] Field of Search ..... 101/212, 216, 415.1, 101/477, 378; 248/205.5, 205.7, 205.8, 205.9, 206.2, 206.3, 363

[56] References Cited

U.S. PATENT DOCUMENTS

| | | | |
|---|---|---|---|
| 2,404,412 | 7/1946 | Stephens | 248/205.9 |
| 2,659,560 | 11/1953 | Lehmann et al. | 248/205.8 |
| 3,649,069 | 3/1972 | Zip | 248/205.9 X |
| 4,883,282 | 11/1989 | Wolf et al. | 248/205.8 X |
| 5,094,165 | 3/1992 | Sugiyama et al. | 101/415.1 |
| 5,127,322 | 7/1992 | Kobler | 101/415.1 X |
| 5,218,907 | 6/1993 | Komori et al. | 101/415.1 |

FOREIGN PATENT DOCUMENTS

| | | | |
|---|---|---|---|
| 0435410 | 7/1991 | European Pat. Off. . | |
| 0503750 | 9/1992 | European Pat. Off. | 101/415.1 |
| 8215605 | 9/1982 | Germany . | |
| 0022755 | 2/1984 | Japan | 101/415.1 |
| 0073850 | 4/1985 | Japan | 101/415.1 |
| 0176558 | 7/1989 | Japan | 101/415.1 |
| 1176558 | 7/1989 | Japan . | |
| 0176153 | 7/1991 | Japan | 101/415.1 |
| 0284252 | 10/1992 | Japan | 101/415.1 |
| 1006042 | 9/1965 | United Kingdom . | |

*Primary Examiner*—Edgar S. Burr
*Assistant Examiner*—Christopher A. Bennett
*Attorney, Agent, or Firm*—Herbert L. Lerner; Laurence A. Greenberg

[57] ABSTRACT

Holding device for a plate which is to be displaced and which is formed with a hole includes a suction cup having a sealing, elastic suction lip for sealing off a space within the suction cup when the plate is pressed against the suction lip, in a plate-holding condition of the holding device, the suction lip being formed of a material having good sliding properties and, in the plate-holding condition of the holding device, being disposed relative to the hole formed in the plate so that, upon a sliding displacement of the plate, the hole formed in the plate passes the suction lip and into the space within the suction cup, in a plate-releasing condition of the holding device.

15 Claims, 4 Drawing Sheets

15
20
23
14
24
21
5
11
1
19
22
2'
17
1
18
16
10
25
12
13

HOLDING DEVICE FOR A PLATE WHICH IS TO BE DISPLACED

SPECIFICATION

The invention relates to a holding device for a plate which is to be displaced, the holding device having a suction cup formed with a sealing, elastic suction lip for sealing off a space when the plate is pressed against the suction lip.

Suction cups are sufficiently well known, for example, as holders or mounting supports on wall tiles. Such suction cups may also be permanently anchored in order to hold a plate. If such a plate is to be moved and simultaneously held by the suction cup, however, it is necessary for the suction cup to be displaceably guided in a guide with the plate. In order to release the connection between the suction cup and the plate, it is necessary to apply a force which is greater than the holding force of the suction cup, or it is necessary to provide a vent, for example by means of a valve, which vents or admits air into the suction-cup space.

It is an object of the invention to provide a holding device of the type described in the introduction to this specification which, without the introduction of an increased force or of a venting channel or duct having a controlled valve, automatically releases in a desired position a plate which is to be displaced.

With the foregoing and other objects in view, there is provided, in accordance with the invention, a holding device for a plate which is to be displaced and which is formed with a hole, the holding device comprising a suction cup having a sealing, elastic suction lip for sealing off a space within the suction cup when the plate is pressed against the suction lip, in a plate-holding condition of the holding device, the suction lip being formed of a material having good sliding properties and, in the plate-holding condition of the holding device, being disposed relative to the hole formed in the plate so that, upon a sliding displacement of the plate, the hole formed in the plate passes the suction lip and into the space within the suction cup, in a plate-releasing condition of the holding device.

Advantages of the invention are that the holding device is of simple construction and can be manufactured at extremely low cost. It is simple and convenient to use while providing high operational reliability.

An especially advantageous application of the holding device according to the invention is for holding printing plates which are to be fed to a plate cylinder of a printing press. For this purpose, the pressman places the leading edge of the printing plate into a clamping device and presses the non-printing side of the printing plate onto the suction cup of the holding device. The printing press draws or feeds the printing plate in so that it slides past the holding device until a hole in the printing plate passes the suction lip. Such holes are conventionally formed at the end of a printing plate anyway, because they are needed for plate making and/or the punching of U-shaped cutouts for positioning the printing plates. By venting the space within the suction cup with the aid of the hole, the holding element releases the printing plate, and the latter can be drawn farther into the printing press. Such an automatic release is necessary in the case of printing plates which have bent-away trailing edges for the purpose of clamping and tensioning the printing plate on the plate cylinder. Thus, venting by means of the hole provides a prompt release of the printing plate, enabling the latter to be drawn into the printing press. After the printing plate has been released by the holding element, it drops down a little under its own weight, so that the bent-away trailing edge is able to slide past the holding element. Either one suction cup or a row of suction cups may be arranged in this manner. It is also possible for a plurality of suction cups to be disposed in the direction in which the printing plate is drawn or fed in, the printing plate being released by the suction cups in succession. This is advantageous, particularly, for large printing plates, so that they can be reliably guided and held. After being released by a last or only a single holding element, the printing plate is caught by a press-on element which is used simultaneously for inserting the trailing edge of the printing plate into the appropriate device of the plate cylinder. The press-on element is disposed so that, with a slight lateral offset, it is situated at the lower end of a straight line which leads to the suction cup or cups, extending in the plate-changing position between the clamping surfaces of the device for holding the printing-plate leading edge.

Thus, in accordance with another feature of the invention, the suction lip has a diameter and the space has a volume adequate for producing a holding force for simultaneously holding the plate and permitting sliding between the plate and the suction lip.

In accordance with a further feature of the invention, the space has a volume which is variably adjustable in accordance with a desired holding force.

In accordance with an added feature of the invention, the space is formed in a rigid body, and the elastic suction lip is attached to the rigid body.

In accordance with an additional feature of the invention, the space is formed in a rigid body comprising a piston-cylinder unit having a piston displaceable in position in a cylinder thereof, the space having a volume adjustable by the position of the piston.

In accordance with yet another feature of the invention, the elastic suction lip has an edge spaced a given axial distance from the rigid body, in the plate-releasing condition of the holding device, and the suction lip is deformed so that the rigid body engages the plate, in the plate-holding condition of the holding device.

In accordance with yet a further feature of the invention, the elastic suction lip has an edge spaced a given axial distance from the rigid body, in a starting condition of the holding device wherein no suction is applied thereby, the spaced axial distance being of such dimension that a partial vacuum required for a desired holding force is producible in the space upon a pressing of the plate and the elastic suction lip together.

In accordance with yet an added feature of the invention, the elastic suction lip is formed of rubber having a hardness of 40 to 45 Shore.

In accordance with yet an additional feature of the invention, there is provided, in a printing press having at least one printing unit with a plate cylinder, a self-releasing holding device wherein the plate is a printing plate to be fed to the plate cylinder, and the plate cylinder has a device formed with clamping surfaces for clamping a leading edge of the printing plate, and wherein the suction cup is disposed in the one printing unit at least approximately on a straight line extending parallel to the clamping surfaces of the clamping device, passing between the clamping surfaces and leaving the one printing unit in an upwardly inclined direction.

In accordance with still another feature of the invention, at least another suction cup is disposed in the one printing unit at least approximately on the straight line.

It is particularly advantageous to attach the suction cup or cups to a printing-unit protective guard, which is conventionally present anyway and which has to be swung upwardly in order to change the printing plate. Such a printing-unit protective guard is formed of two articulatingly connected parts, the lower part thereof being guided in a guide having a stop at an upper end thereof. The upper part of the printing-unit protective guard is connected to a lever mounted on the printing unit. After the printing-unit protective guard has been swung upwardly, the lower part of the printing-unit protective guard is in contact with the stop in the guide, and the upper part of the printing-unit protective guard is connected to a gas-pressure spring, which ensures that, in an extended condition thereof, when the protective guard is in its upwardly swung condition, it assumes a fixed position. When the printing-unit protective guard is swung downwardly, a change in the angle relationships occurs, and the printing-unit protective guard consequently holds the gas-pressure spring in its retracted condition. This is achieved by the printing unit, the gas-pressure spring and a part of the lever forming a triangle having angles changed by the downward swing of the printing-unit protective guard and, thereby, the forces acting on the gas-pressure spring are consequently also changed.

Thus, in accordance with another feature of the invention, the self-releasing holding device includes an upwardly swingable protective guard for the one printing unit, the suction cup being fastened to the protective guard and being, in an upwardly swung position of the protective guard, at least approximately on the straight line.

In accordance with a further feature of the invention, the suction cup is mounted on a lower part of the printing-unit protective guard, and a guide is mounted on the printing unit, the lower part of the protective guard, at a lower end thereof, being displaceably and swivellably held in the guide and, at an upper end thereof, being articulatingly connected to an upper part of the printing-unit protective guard, a lever attached at an angle to the upper part of the protective guard, the lever being connected by a bearing to the printing unit, the guide having a stop by which the position of the suction cup on the straight line is prescribed by the position of the lower part of the printing-unit protective guard.

In accordance with an added feature of the invention, the holding device includes an extensible and retractable gas-pressure spring disposed between the lever and the printing unit, the printing-unit protective guard being held in the upwardly swung position thereof by the gas-pressure spring, in an extended condition of the latter and, in a downwardly swung position of the protective guard, the gas-pressure spring being in a retracted condition due to a change in angle relationships.

In accordance with an additional feature of the invention, the holding device includes a press-on element mounted in the printing unit for catching and guiding the printing plate following release thereof by the suction cup.

To provide optimal operational reliability, the holding force for the printing plate must be appropriately dimensioned. The necessary holding force depends upon the characteristics of the printing plate. The magnitude of the holding force can be set by means of the diameter of the suction lip of the suction cup and by the dimensioning of the pressure relationships, an increase in the holding force being obtained by an increase in the partial vacuum as well as by an increase in the diameter of the suction lip of the suction cup. The magnitude of the partial vacuum depends upon the magnitude of the volume and amount of air which escapes from the space within the suction cup by pressing the suction lip against the plate. The holding force must be at least of such magnitude that it is sufficient to hold the plate; it must, however, be at most of such magnitude that it is still possible for the suction lip to slide on the plate.

In accordance with a concomitant feature of the invention, the plate cylinder carries a device for clamping a trailing edge of a printing plate therein, and the printing plate is formed with a bent-away trailing edge portion pressable by the press-on element into the device for clamping the trailing edge of the printing plate therein.

A further development of the invention provides that the space within the suction cup is variably adjustable in accordance with the desired holding force. It is possible, in this manner, to adapt the holding device to various printing plates which, because of their weight and surface characteristics, require different holding forces.

The holding device may be so constructed that the volumetric space is formed in a rigid body and that the elastic suction lip is joined to the rigid body. In such a construction of the invention, the variable volumetric space can be provided in a rigid body formed as a piston-cylinder unit, the space being adjustable by the position of the piston. The piston must be of such construction that its setting is lockable, respectively so that its setting cannot be changed. This may, for example, be achieved by providing a threaded spindle passing outwardly through the rigid body, and turnable from the outside. This also permits readjustment during operation.

A further influencing factor with regard to the magnitude of the holding force is the quantity of air which escapes when the plates are being pressed onto the suction cup. Therefore, in a further development of the invention, a precisely defined holding force within a narrow tolerance range is attained by providing a defined axial spacing between an edge of the suction lip and the rigid body, in a condition of the holding device wherein no suction is being applied, and when the plate is pressed against the suction lip, the latter is deformable so that the rigid body comes up against or abuts the plate. Due to the dimensioning of the spaced distance, it is possible for the partial vacuum created in the volumetric space, when the plate is pressed against the suction lip, to be prescribed in accordance with the desired holding force.

Other features which are considered as characteristic for the invention are set forth in the appended claims.

Although the invention is illustrated and described herein as embodied in a holding device for a plate which is to be displaced, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
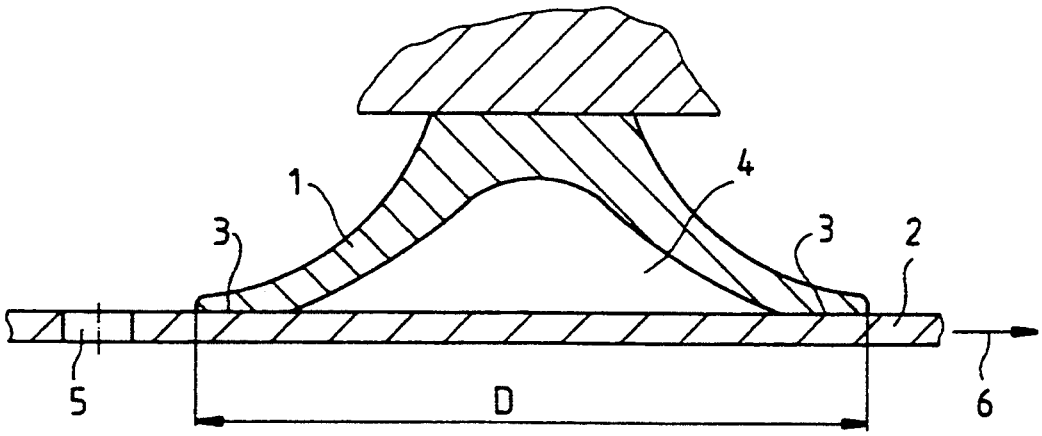
FIG. 1 is a longitudinal sectional view of a relatively simple embodiment of the device according to the invention formed with a suction cup.

Referring now to the drawings and, first, particularly to FIG. 1 thereof, there is shown therein a suction cup 1 which is attached to a fixed part of a printing press, for example, and has a plate 2 has been pressed thereon for the purpose of being held thereby. The suction cup 1 is formed with a suction lip 3 which is elastic and seals off a volumetric space 4 formed in the suction cup 1. When the plate 2 is pressed against the suction cup 1, air escapes from the volumetric space 4, and a partial vacuum is formed therein which holds the plate 2.

As represented in FIG. 1, the plate 2, which is formed with a hole 5 therethrough, is displaced in the direction of the arrow 6. The suction cup 1 and the hole 5 are disposed so that the hole 5, in a position of the plate 2 wherein the holding device is to be released, passes the suction lip 3 due to the displacement of the plate 2 in the direction of the arrow 6. The volumetric space 4 is consequently vented and the suction cup 1 is released from the plate 2. The holding force is determined by the diameter D of the suction lip 3, as well as by the partial vacuum formed in the volumetric space 4. In this relatively simple embodiment of the invention, the partial vacuum and the size of the volumetric space 4 depend also on the force with which the plate 2 is pressed onto the suction cup 1. The highest partial vacuum and thus the greatest holding force are produced by a small volumetric space 4 which is greatly increased in size by a force pulling the plate 2 perpendicularly or vertically away from the suction cup 1.

Figure 2:
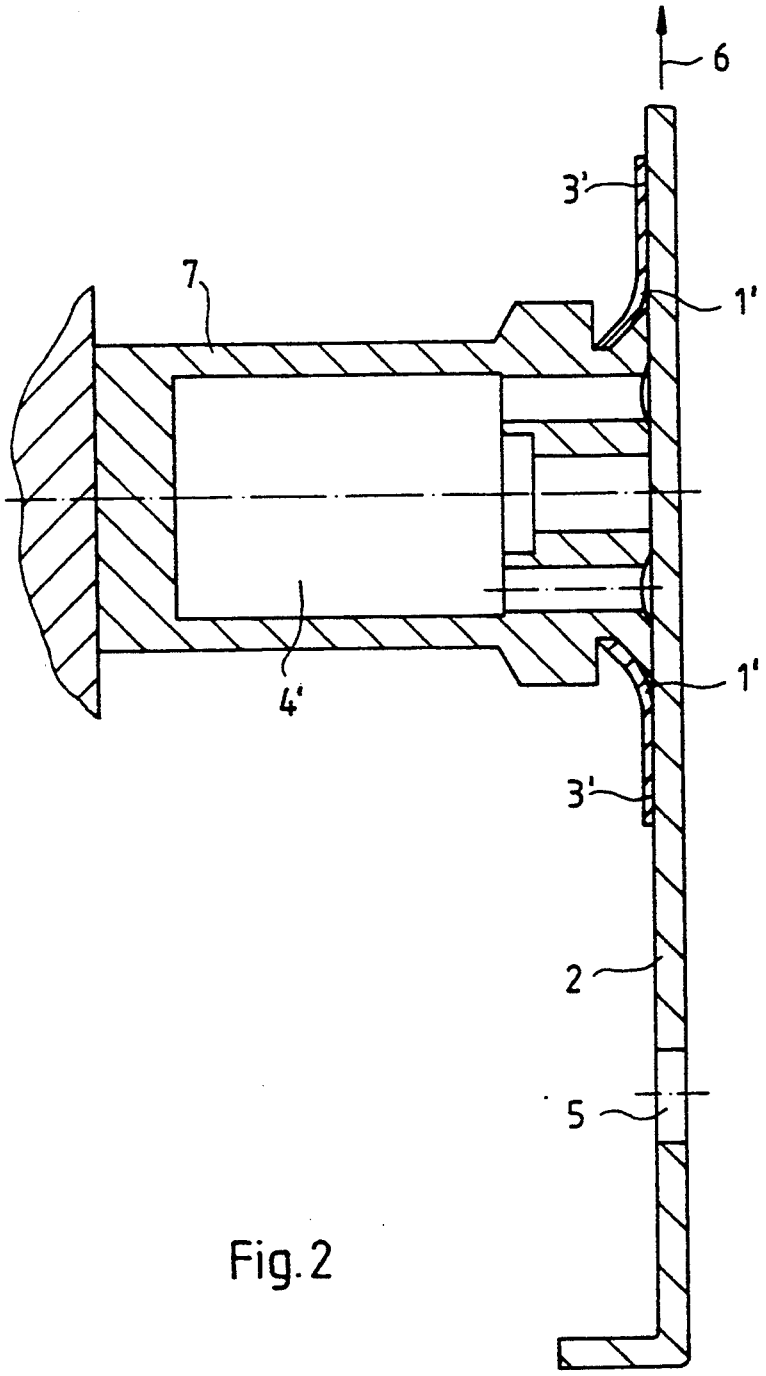
FIG. 2 is a longitudinal sectional view of another embodiment of the device wherein the volumetric space thereof is formed in a rigid body.

FIG. 2 shows an embodiment wherein the volumetric space 4' is formed in a rigid body 7. The suction cup 1' is made up of a funnel-shaped part which is joined to the solid body 7. It is believed to be apparent from FIG. 2 that the holding device has been pressed onto the plate 2 to such an extent that the rigid body 7 has come up against the plate 2. When the plate 2 was pressed onto the suction cup 1', the suction cup 1' was correspondingly deformed, the distance a (FIG. 3) between the solid body 7 and the edge of the suction lip 3', in the condition thereof shown in FIG. 3 wherein it is not sucked by friction against the plate 2, having been eliminated. In this manner, a precisely defined quantity of air escapes and the holding force can consequently be reproducibly prescribed within a narrow tolerance range. This reproducible setting or adjustment is of significance for the reason that, if the holding force is too great, the sliding resistance of the suction cup on the plate becomes too great, yet, conversely, the holding force must be of sufficient strength to hold the plate reliably.

The plate 2 shown in FIG. 2 is a printing plate which, at an end thereof, has a bent-away portion beyond which the holding device according to the invention is unable to slide. It is necessary, therefore, for the suction cup 1' to release the printing plate 2 before the bent-away end region of the printing plate 2 is reached thereby. This is ensured by the provision of the hole 5 in the printing plate 2, the hole 5 having been formed conventionally in most printing plates for the purpose of making additional plates and for the purpose of punching further holes or cutouts, respectively. Of course, the field of use or application is not confined to printing plates; it is also possible for other plates to be held in this manner until a predetermined position is reached.

Figure 3:
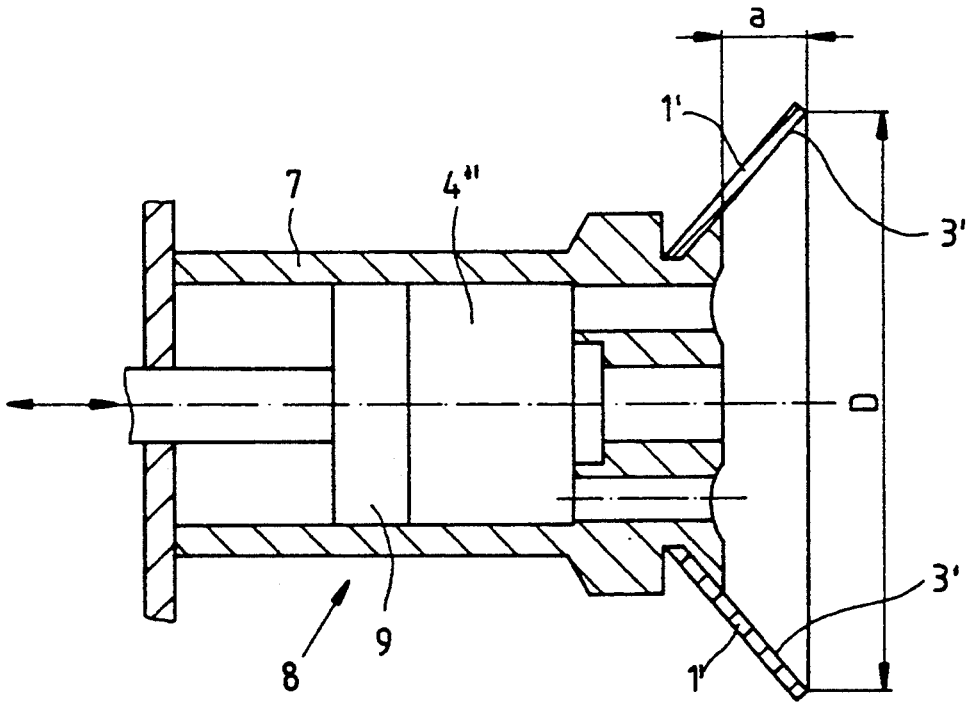
FIG. 3 is a longitudinal sectional view of a third embodiment of the device according to the invention having a variably adjustable volumetric space.

FIG. 3 illustrates another embodiment of the device according to the invention having a volumetric space 4'' which is provided in a rigid body 7' formed as a piston-cylinder unit. In this embodiment, the volumetric space 4'' is adjusted by the position of a piston 9. Adjustment may be effected, for example, by means of a threaded spindle, which has the advantage that it is possible thereby to vary the desired holding force. In a suitable construction, it is also possible for the adjustment to be made during operation. The adjustable volumetric space 4'' permits plates of different weight and different surface characteristics to be held so that they are reliably guided while, nevertheless, the suction lip 3' slides easily on the plate 2.

Figure 4:
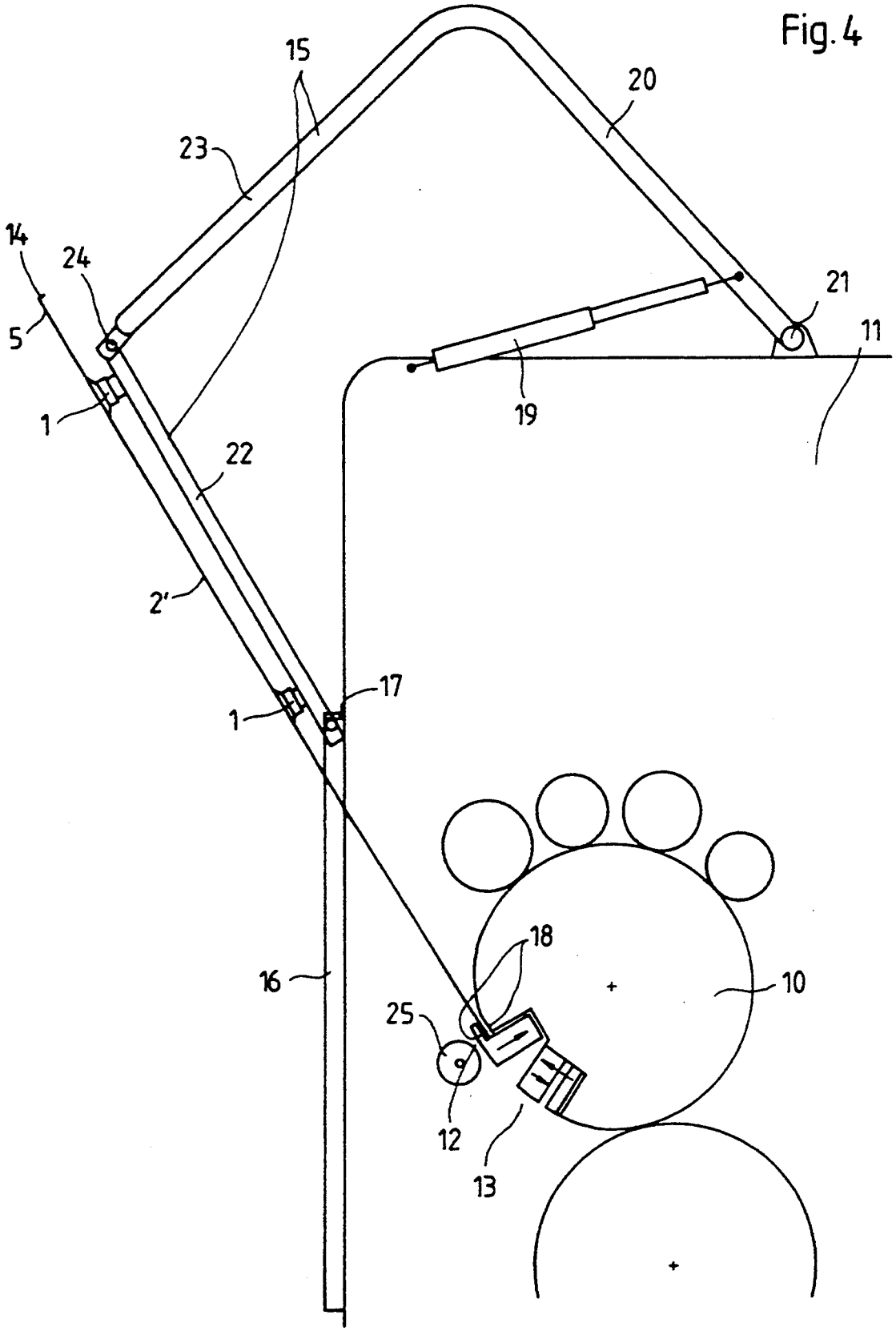
FIG. 4 is a diagrammatic elevational view of an application of the holding device according to the invention to a printing plate for a plate cylinder of a printing press.

FIG. 4 shows a construction which represents an application of the holding device according to the invention. The suction cups 1 are disposed on a lower part 22 of a protective guard 15 for a printing unit 11, the part 22 being aligned so that the suction cup or cups 1 assume a position wherein they are situated on a straight line extending parallel to clamping surfaces 18 of a device 13 for clamping a leading edge of a printing plate 2', passing between the clamping surfaces and leaving the printing unit 11 in an upwardly inclined direction. For this purpose, a predetermined position of the plate cylinder 10 is required wherein the clamping surfaces 18 of a device 12 for clamping the leading edge of the printing plate 2' are aligned in accordance with the aforementioned straight line.

The lower part 22 of the printing-unit protective guard 15 is guided in a guide 16 which is provided with a stop 17. With the printing-unit protective guard 15 in the illustrated upwardly swung position, which corresponds to the plate-changing position, the printing-unit protective guard 15 is held by a lever 20 which is connected by a bearing 21 to the printing unit 11. The lever 20 is, in turn, rigidly connected so as to form an angle with an upper part of the printing-unit protective guard 23. A gas-pressure spring or strut 19 is disposed between the lever 20 and the printing unit 11. The gas-pressure spring 19, the part of the lever 20 extending from the bearing 21 thereof to a bearing point thereon for the gas-pressure spring 19, and the printing unit 11 form a triangle which, when the printing-unit protective guard 15 is closed, with the gas-pressure spring 19 being compressed or retracted, changes so that the upper angle of the triangle, as viewed in FIG. 4, becomes an angle of almost 180 degrees. The lever which is available to the gas-pressure spring 19 for opening the printing-unit protective guard 15 consequently becomes very small and the gas-pressure spring 19 remains in its compressed or retracted state. FIG. 4 shows two suction cups 1 on the lower part of the printing-unit protective guard 22, the upper suction cup 1 thereof becoming vented when the hole 5 in the printing plate 2' reaches it. The upper suction cup 1 releases the plate 2'. The bent-away trailing edge of the printing plate 2' slides past the suction cup 1, which has released the printing plate 2', because it drops down slightly under its own weight, thereby removing itself a little from the suction cup 1. This applies both with regard to the arrangement of one suction cup or a horizontal row of suction cups and also with regard to the arrangement of a plurality of vertical suction cups or rows of suction cups which are disposed one above the other and consequently come out of engagement at different times. As the printing plate 2' is wound further around the plate cylinder 10, the hole 5 reaches the second, lower suction cup 1, as a result of which the latter is vented and releases the printing plate 2'. The printing plate 2' then falls downwardly and is caught and guided by a press-on element 25. The printing plate 2' is then wound completely around the plate cylinder 10 and is inserted by means of the press-on element 25 into the device 13 for clamping the trailing edge of the printing plate 2' and is clamped and tensioned. The insertion of the printing-plate trailing edge is effected by a radial movement of the press-on element 25 in the direction of the plate cylinder 10.

The foregoing is a description corresponding in substance to German Application P 42 14 047.1, dated Apr. 29, 1992, the International priority of which is being claimed for the instant application, and which is hereby made part of this application. Any material discrepancies between the foregoing specification and the aforementioned corresponding German application are to be resolved in favor of the latter.

I claim:

1. In combination, a plate which is to be displaced formed with a hole and a holding device for the plate, the holding device comprising a suction cup formed with an inner Space and having a sealing, elastic suction lip for sealing off said space within said suction cup when the plate is pressed against the suction lip so as to form a partial vacuum in said space in a plate-holding condition of the holding device, said suction lip being formed of a material slidable on the plate and, in said plate-holding condition of the holding device, being disposed relative to the hole formed in the plate so that, upon a sliding displacement of the plate, the hole formed in the plate passes said suction lip thereby releasing the partial vacuum to thereby release the plate from the holding device.

2. The combination according to claim 1, wherein said suction lip has a diameter and said space has a volume adequate for producing a holding force for simultaneously holding the plate and permitting sliding between the plate and said suction lip.

3. The combination according to claim 1, wherein said space has a volume which is variably adjustable in accordance with a desired holding force.

4. The combination according to claim 1, wherein said holding device is a rigid body wherein said space is formed, and said elastic suction lip is attached to said rigid body.

5. The combination according to claim 1, wherein said holding device is a rigid body wherein said space is formed comprising a piston-cylinder unit having a cylinder and a piston displaceable in position in said cylinder, said space having a volume adjustable by the position of the piston.

6. The combination according to claim 4, wherein said elastic suction lip has an edge spaced a given axial distance from said rigid body, in said plate-releasing condition of the holding device, and said suction lip is deformed so that said rigid body engages the plate, in said plate-holding condition of the holding device.

7. The combination according to claim 4, wherein said elastic suction lip has an edge spaced a given axial distance from said rigid body, in a starting condition of the holding device wherein no vacuum is applied thereby, said spaced axial distance being of such dimension that the partial vacuum required for a desired holding force is producible in said space upon the pressing of the plate and said elastic suction lip together.

8. The combination according to claim 1, wherein said elastic suction lip is formed of lubber having a hardness of 40 to 45 Shore.

9. In a printing press having at least one printing unit with a plate cylinder, the combination according to claim 1, wherein the plate is a printing plate to be fed to the plate cylinder, and the plate cylinder has a device formed with clamping surfaces for clamping a leading edge of the printing plate, and wherein said suction cup is disposed in the one printing unit at least approximately on a straight line extending parallel to said clamping surfaces of said clamping device, passing between said clamping surfaces and leaving the one printing unit in an upwardly inclined direction.

10. The combination according to claim 9, including at least another suction cup disposed in the one printing unit at least approximately on said straight line.

11. The combination according to claim 9, including an upwardly swingable protective guard for the one printing unit, said suction cup being fastened to said protective guard and being, in an upwardly swung position of said protective guard, at least approximately on said straight line.

12. The combination according to claim 11, wherein said printing-unit protective guard has a lower and upper part, said suction cup being mounted on said lower part of said printing-unit protective guard, and including a guide mounted on the printing unit, said lower part of said protective guard, at a lower end thereof, being displaceably and swivellably held in said guide and, at an upper end thereof, being articulatingly connected to an upper part of said printing-unit protective guard, a lever attached at an angle to said upper part of said protective guard, a bearing connecting said lever to the one printing unit, said guide having a stop by which the position of said suction cup on said straight line is prescribed by the position of the lower part of said printing-unit protective guard.

13. The combination according to claim 11, including an extensible and retractable gas-pressure spring disposed between said lever and the printing unit, said printing-unit protective guard being held in said upwardly swung position thereof by said gas-pressure spring, in an extended condition of said gas-pressure spring and, in a downwardly swung position of said protective guard, said gas-pressure spring being in a retracted condition due to a change in angle relationships.

14. The combination according to claim 9, including a press-on element mounted in the printing unit for catching and guiding the printing plate following release thereof by said suction cup.

15. The combination according to claim 14, wherein the plate cylinder carries a device for clamping a trailing edge of a printing plate therein, and wherein the printing plate is formed with a bent-away trailing edge portion pressable by said press-on element into said device for clamping the trailing edge of the printing plate therein.

* * * * *